United States Patent [19]

Ringle, III

[11] 4,096,903

[45] Jun. 27, 1978

[54] POWER DRIVE FOR A VENETIAN BLIND

[76] Inventor: John Ringle, III, 1410 Fairmont St., Wausau, Wis. 54401

[21] Appl. No.: 611,015

[22] Filed: Sep. 8, 1975

Related U.S. Application Data

[63] Continuation-in-part of Ser. No. 485,820, Jul. 5, 1974, abandoned, which is a continuation of Ser. No. 307,979, Nov. 20, 1972, abandoned.

[51] Int. Cl.[2] ..... E06B 9/26

[52] U.S. Cl. ..... 160/176 R; 160/107; 318/266; 318/467

[58] Field of Search ..... 160/107, 170, 171, DIG. 17, 160/174–176; 318/467, 468, 470, 265, 266, 267

[56] References Cited

U.S. PATENT DOCUMENTS

| | | | |
|---|---|---|---|
| 1,894,833 | 1/1933 | Ruby et al. | 160/171 |
| 2,658,570 | 11/1953 | Engel | 160/107 X |
| 2,755,423 | 7/1956 | Hager | 318/468 X |
| 3,308,873 | 3/1967 | Dotto | 160/DIG. 17 UX |
| 3,310,099 | 3/1967 | Hunter et al. | 160/171 |
| 3,389,737 | 6/1968 | Arnold et al. | 160/107 |
| 3,559,024 | 1/1971 | Marder | 160/DIG. 17 UX |
| 3,714,535 | 1/1973 | Krivak et al. | 318/468 |

*Primary Examiner*—Philip C. Kannan
*Attorney, Agent, or Firm*—Andrus, Sceales, Starke & Sawall

[57] ABSTRACT

The upper channular frame supporting the venetian blind houses a rotary shaft parallel to the slats of the blind and from which the slats are suspended by a pair of nylon ladders. The shaft is driven by a small D.C. motor and gear reduction unit having an output governed by limit switches selectively operable to provide a predetermined limit of angular slat movement. The limit switches are incorporated in parallel branches directly in one of the power lines to the motor, with individual diodes controlling the direction of the current through the corresponding branches.

6 Claims, 15 Drawing Figures

Fig. 10
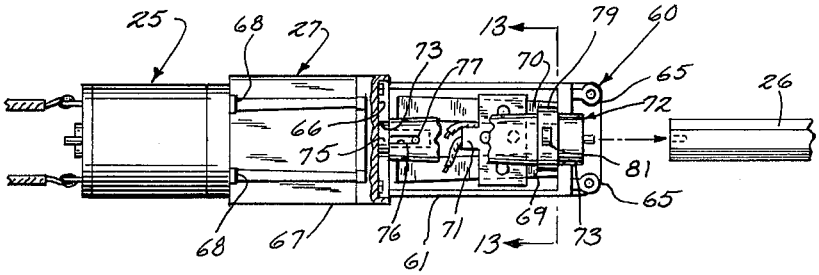
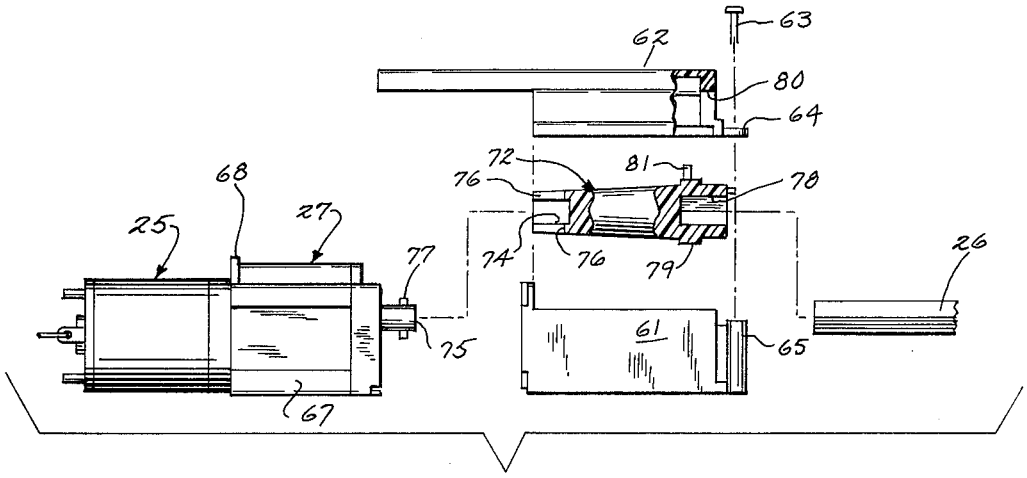
Fig. 11
Fig. 12
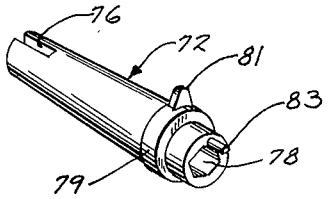
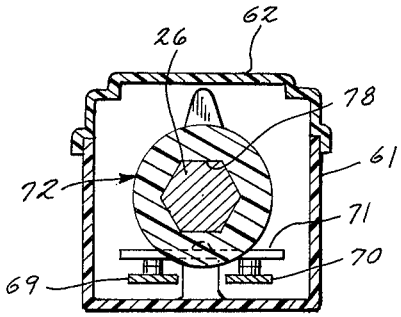
Fig. 13
Fig. 14
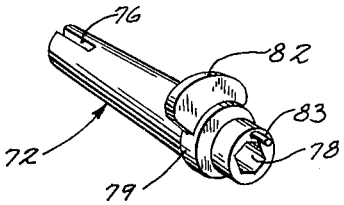
Fig. 15
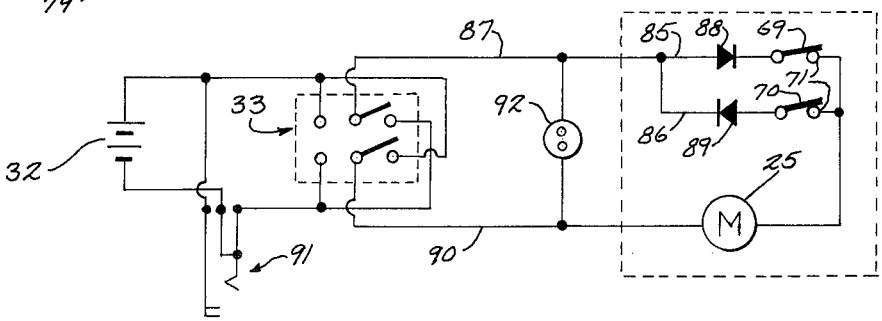

POWER DRIVE FOR A VENETIAN BLIND

CROSS REFERENCE TO RELATED APPLICATIONS

This application is a continuation-in-part of application Ser. No. 485,820, filed July 5, 1974 now abandoned, which in turn was a continuation of application Ser. No. 307,979, filed Nov. 20, 1972 now abandoned by the present inventor.

BACKGROUND OF THE INVENTION

This invention relates to a power drive for a venetian blind.

The present invention is directed solely to tilting of the slats of a blind by power means. Raising and lowering of venetian blinds requires substantial power and mechanisms for this purpose are necessarily complicated and costly. On the other hand the tilting of the slats of a venetian blind can be accomplished with very little power and this operation is susceptible of much less costly drives.

Present day high rise buildings employ venetian blinds at all of the windows and it is generally desired that they all remain down and even preferably at the same tilt adjustment to present a uniform exterior appearance for the building. In such case some remote control of the tilt of the blinds is desired.

This type of venetian blind, incorporating the very thin slats, is usable also in buildings where individual blind control is permissible.

The problem in these tilt controls for such blinds is largely one of simplification resulting in reduced manufacturing costs.

Heretofore the expense involved has generally kept these drives from the market.

SUMMARY OF THE INVENTION

The present invention utilizes a small direct current electric motor with a substantial gear reduction unit driving the cross shaft from which the slats of the blind are suspended.

A coupling between the gear reduction unit and the cross shaft incorporates a limit switch mechanism which provides a predetermined tilt limitation of the slats by selective incorporation in the coupling of an element constructed to actuate the limit switches as desired.

The limit switches are incorporated in individual branches of one lead to the motor and each has a diode in its branch controlling the direction of current flow through the corresponding switch in response to a given direction of current flow through the motor.

The direction of current flow through the motor is controlled by a manual and/or an automatic switch responsive to light, temperature and/or infra-red rays admitted through the blind.

The current source is preferably a small replaceable battery disposed near the control switch, although a rectified AC current may be employed with a transformer from the normal power source available.

An additional remote control switch may be provided and which may actuate several blinds simultaneously.

The power unit is mounted at one end of the cross shaft while the control switch is mounted in the sash or other convenient location.

Where the blind is disposed in a sealed space between two panes the motor, gearing and cross shaft will be in the same space and the control switch and batteries will be outside the space.

In the construction of a pivoted window the control switch and batteries may be contained in a casing or box sunk in the sash of the window at a position convenient to the operator, thereby making a unitary factory assembled construction for simpler installation.

Where fixed windows are employed it is possible to power the individual blinds for adjacent windows from a common battery.

BRIEF DESCRIPTION OF THE DRAWINGS

The invention is illustrated in the accompanying drawings showing the preferred embodiment presently contemplated by applicant.

In the drawings:

FIG. 10 is a plan view with cap removed showing a modified form of power unit;

FIG. 11 is an exploded view showing the parts of the coupling ready for assembly;

FIG. 12 is a perspective view showing one form of coupling element for actuating the limit switches at nearly 180° apart;

FIG. 13 is a transverse section taken on line 13—13 of FIG. 10.

FIG. 14 is a perspective view of an alternate form of coupling element for actuating the limit switches at nearly 90° apart; and FIG. 15 is a modified form of circuit diagram.

DESCRIPTION OF THE PREFERRED EMBODIMENT

Figure 1:
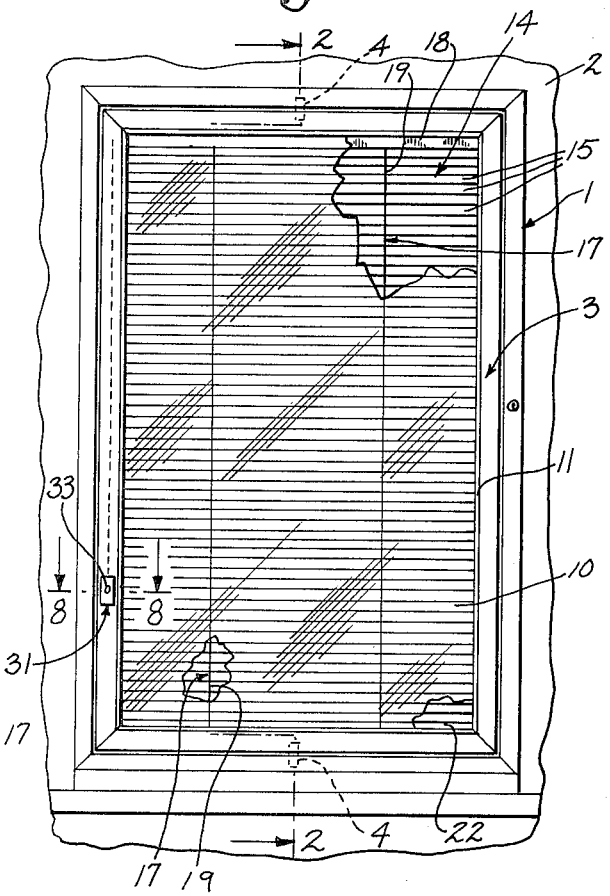
FIG. 1 is a front elevation of a window with venetian blind.
Figure 2:
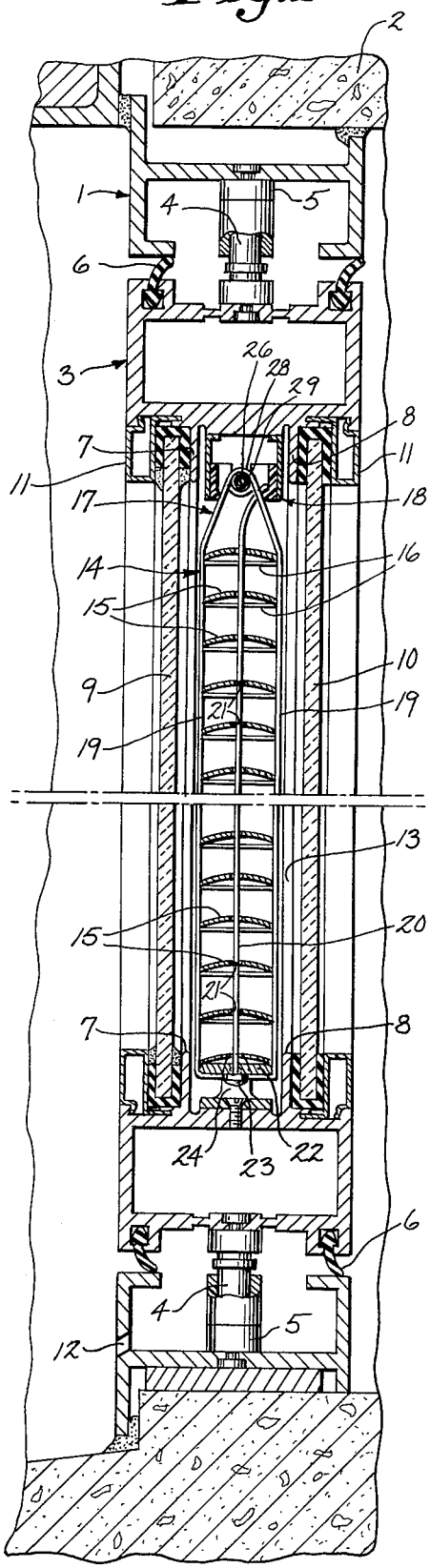
FIG. 2 is an enlarged vertical section taken on line 2—2 of FIG. 1.

The drawings illustrate a factory assembled window having an extruded aluminum channular frame 1 adapted to be set in an opening in the masonry wall 2 of a building and sealed in place.

The frame 1 pivotally carries an extruded aluminum hollow sash 3 by means of aligned upper and lower central trunnions 4 of the sash extending through bearings 5 in the frame. This construction permits the window to be turned to present either side to the inside of the building for washing purposes.

Suitable sealing strips 6 extend peripherally of the sash 3 to seal the same to the frame 1 when the two are in the same plane and thereby securely close the window.

The hollow sash 3 is generally of rectangular section having a pair of spaced inwardly extending flanges 7 and 8 against which separate panes of glass 9 and 10 are sealed and secured in place by strips 11.

Suitable outside weep holes 12 may be provided for the channular frame 1 to prevent possible retention of moisture therein.

The space 13 between window panes 9 and 10 may be hermetically sealed and suitably dehydrated, vacuumized or filled with a dehydrated gas, as desired.

Figure 7:
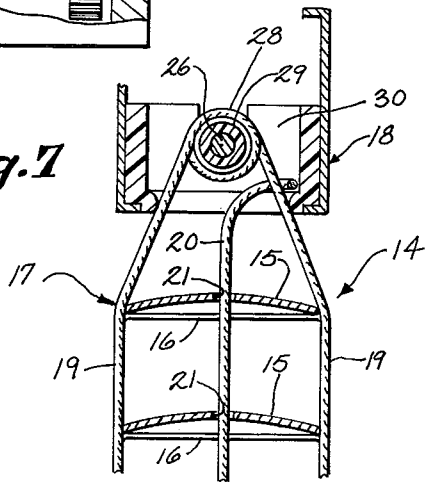
FIG. 7 is a detail section taken on line 7—7 of FIG. 3 and showing the suspension of the slats from the cross shaft.

In carrying out the present invention a venetian blind 14 is disposed within the space 13 between panes 9 and 10 and is comprised of a plurality of vertically spaced thin opaque slats 15 which may be slightly curved or crowned in cross section as shown in FIG. 7 to stiffen the same against sagging.

The slats 15 are carried by the cross rungs 16 of a pair of spaced nylon ladders 17 suspended from a head rail 18 secured to the upper sash 3 of the window.

Each ladder 17 comprises a pair of vertical cords 19 joined by the vertically spaced rungs 16 which support the individual slats 15 therebetween.

The cords 19 serve to keep the slats 15 in vertical superposed alignment and relative vertical movement of the cords will tilt the rungs 16 accordingly and thereby effect tilting of the slats.

Relative endwise displacement of individual slats 15 may be prevented by an additional cord 20 hanging from the head rail 18 and passing through central openings 21 in the several slats with its lower end secured to a bottom rail 22.

The bottom rail 22 of the blind has a trunnion 23 at each end pivotally mounting the same in a hold down bracket 24 secured to the sash 3.

The slats 15 of the venetian blind 14 are thus always extending across the window between the vertical side members of sash 3 and in this embodiment the slats cannot be raised to the top of the window.

By tilting the slats 15 in unison in either direction it is possible to control the amount of light and heat passing through the window.

When the slats are disposed generally horizontally they permit the maximum amount of light to pass through the window and are generally least obstructing to a person's vision through the window.

When the slats are tilted to a maximum amount in either direction where they overlap in a generally vertical position they close the window to the passage of light and to any vision therethrough by a person looking toward the window.

According to the present invention tilting of the slats 15 is effected electrically by a small electric motor 25 disposed in one end of the head rail 18.

The motor 25 drives a shaft 26 by means of a gear reduction unit 27 in head rail 18.

The shaft 26 extends transversely of the window lengthwise of the hollow head rail 18, and is rotated very slowly to give a desired control of adjustment for the slats 15.

For this purpose, the vertical cords 19 for each ladder 17 have their upper ends wound around and secured to a cylindrical nylon bushing 29 and provide a sufficient length of cord free to pay out upon rotation of the bushing with shaft 26 to grip the same, thereby lowering one side of ladder 17 and simultaneously lifting the other side of the ladder as the bushing oscillates slowly with the shaft.

The lower end of each cord 19 will be secured to the corresponding side of the bottom rail 22 whereby the bottom rail will tilt on its trunnions 23 as the slats 15 are tilted by raising and lowering of the cords 19.

Bushing 29 has ends of reduced diameter which ride in slots in nylon supports 30 fixed in rail 18 and constituting a bearing support rotationally mounting shaft 26.

Tilting of slats 15 in either direction is accomplished by reversal of motor 25 which reverses the direction of rotation of shaft 26.

For this purpose the motor 25 is preferably a direct current motor which can be readily reversed by reversing the voltage applied to it.

Figure 9:
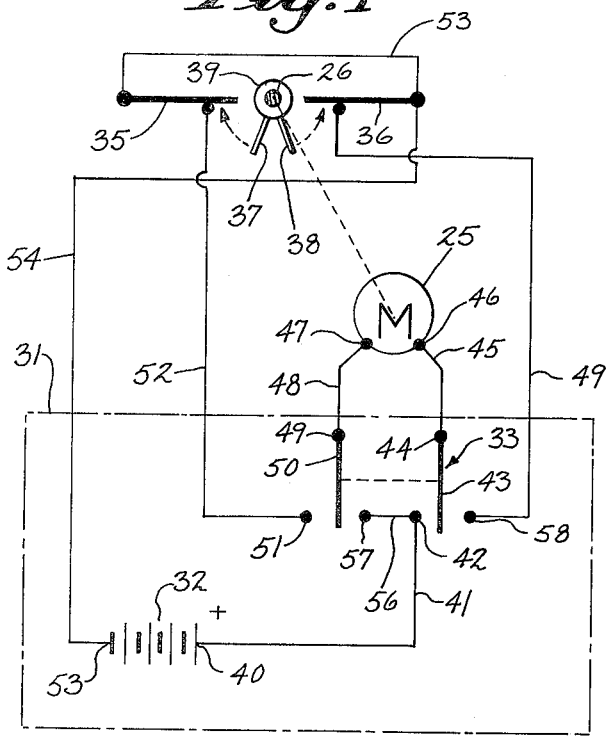
FIG. 9 is a wiring diagram for operating the motor in either direction.
Figure 3:
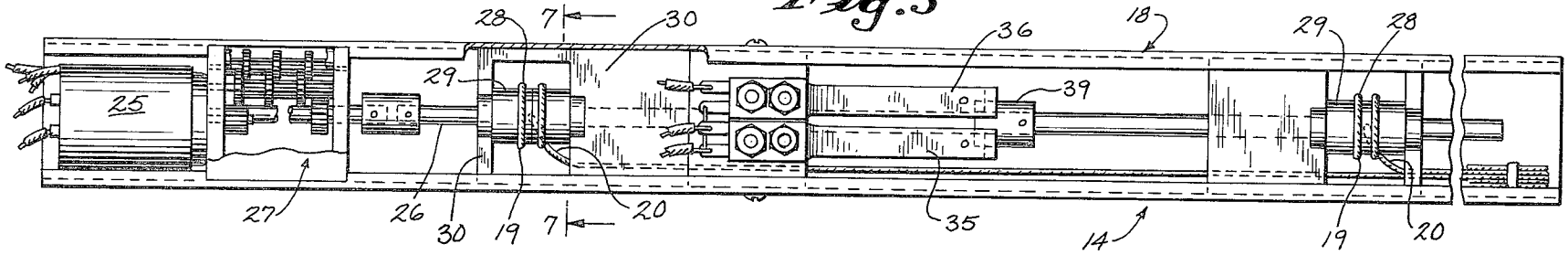
FIG. 3 is a plan view of the head rail for the blind.
Figure 6:
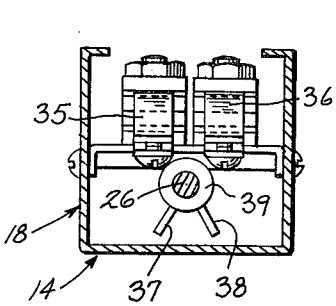
FIG. 6 is a detail section taken on line 6—6 of FIG. 5.
Figure 5:
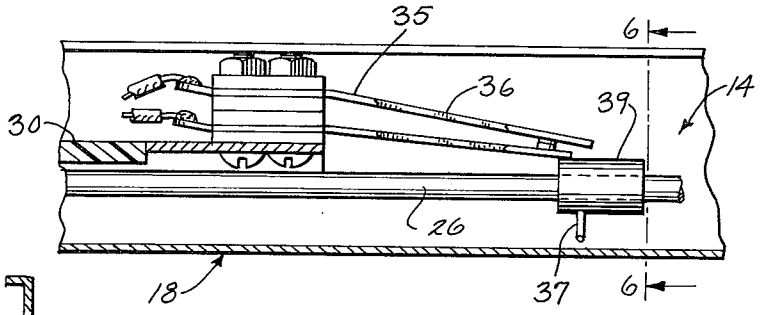
FIG. 5 is an enlarged detail of the micro switches and adjacent portion of the head rail and cross shaft.
Figure 4:
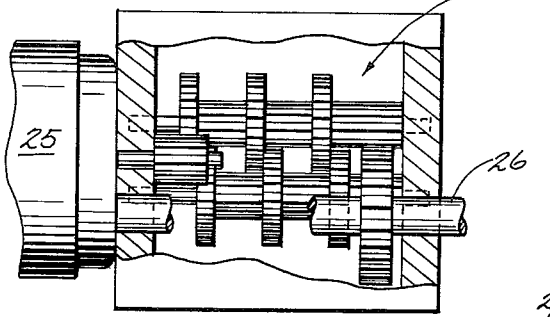
FIG. 4 is an enlarged detail of the gear reduction unit.
Figure 8:
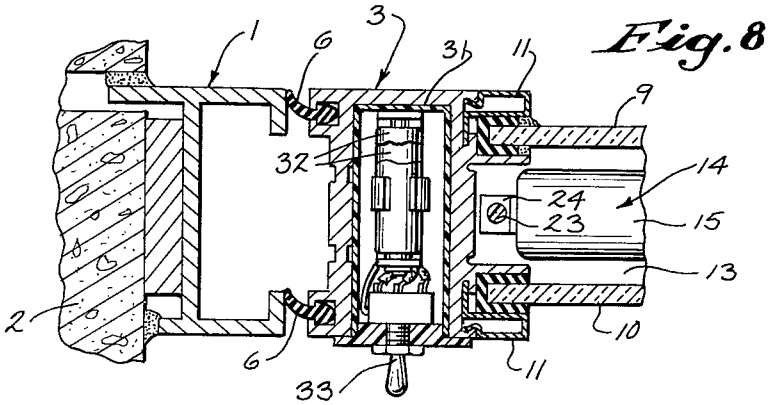
FIG. 8 is a horizontal transverse section taken on line 8—8 of FIG. 1.

A suitable circuit diagram is illustrated in FIG. 9 where it will be noted that a remote control box 31 contains suitable replaceable small batteries 32 and has a double pole double throw normally open switch 33 on its removable cover 34.

The box 31 with its assembly can be positioned in a recess in sash 3 at a location convenient to access to switch 33 by the operator.

Referring to the wiring diagram of FIG. 9 it will be noted that the switch 33 is adapted to reverse the voltage from batteries 32 to the motor 25.

In order to limit the tilting movement of slats 15 in either direction a pair of limit switches 35 and 36 are connected in the motor circuit by switch 33.

Limit switches 35 and 36 are normally closed and disposed in head rail 18 to be opened by corresponding radial projections 37 and 38 on a bushing 39 on shaft 26.

When shaft 26 is rotated in a direction in which limit switch 35 is connected in the motor circuit by control switch 33, projection 37 rotating with the shaft will ultimately lift the blade of the limit switch 35 and open the latter to stop the motor at a predetermined tilt position for slats 15 in one direction.

Specifically for this direction of rotation of shaft 26 the current flows from positive terminal 40 of battery 32 through line 41 to terminal 42 of switch 33, through throw 43 to switch connection 44, and thence through line 45 to terminal 46 of motor 25, and returns from terminal 47 of motor 25 through line 48 to connection 49 of switch 33, throw 50 and switch terminal 51, through line 52 to normally closed limit switch 35 and thence through lines 53 and 54 to the negative terminal 55 of battery 32.

When shaft 26 is rotated in the opposite direction in which limit switch 36 is connected in the motor circuit by control switch 33, projection 38 rotating with the shaft will ultimately lift the blade of the limit switch 36 and open the latter to stop the motor at a predetermined tilt position for slats 15 in the opposite direction.

Specifically for this reverse direction of rotation of shaft 26 the current flows from positive battery terminal 40 through line 41 to switch terminal 42, line 56 to switch terminal 57, throw 50 to switch connection 49 and line 48 to motor terminal 47, and returns from motor terminal 46 through line 45 to switch connection 44, throw 43 to switch terminal 58, through line 49 to limit switch 36 and thence through lines 54 to negative terminal 55 of battery 32.

The limit switches 35 and 36 are constructed to prevent continued operation of motor 25 when the slats 15 have reached a predetermined tilt position corresponding to the radial positioning of projections 37 and 38 on shaft 26.

Thus projections 37 and 38 will be positioned to give a range of tilt for slats 15 of any angular movement up to a total of 180° depending upon the need. In some instances a range of tilt of only 45° may be sufficient where the blind is employed to regulate the light being transmitted as by a light sensitive control element operatively connected to the switch 33.

The shaft 26 rotates in either direction only through the angular range of movement established by the setting of projections 37 and 38, and thus can be said to oscillate between the two extreme positions for slats 15.

The modified construction of power unit illustrated in FIGS. 10 to 14 considerably reduces the space required by providing the motor 25, gear reduction assembly 27 and the coupling assembly 60 as a power unit which can be pre-assembled for installation with shaft 26 of any window.

In this construction the motor 25 and gear reduction assembly 27 remain substantially as illustrated in the construction of FIGS. 1-9.

The coupling assembly 60 comprises a two piece housing consisting of support member 61 and cap member 62 secured together upon assembly by two rivets 63 driven through eyelets 64 at one end of cap 62 into corresponding vertical tubular members 65 at the end of support 61.

The end of support 61 opposite from members 65 is shaped to fit into an end recess 66 of the housing 67 for gear reduction assembly 27.

The end of cap 62 opposite from eyelet 64 extends over the housing 67 and interlocks with a raised tongue 68 thereon.

The support member 61 contains the two resilient limit switch terminals 69 and 70 normally contacting a fixed terminal 71 and adapted to be pushed away from contact position to open the motor circuit.

The coupling element 72 is formed of synthetic plastic material and lies in bearing recesses 73 in the opposite ends of support member 61.

The smaller diameter inner end of element 72 has a central axial bore 74 therein for receiving the end 75 of the output shaft of gear reduction assembly 27, and is slotted diametrically at 76 to receive the cross driving pin 77 of end 75, to rotationally drive the coupling element by the output shaft of assembly 27.

The larger diameter outer end of element 72 has an axial bore 78 formed to receive the end of cross shaft 26, each having a hexagonal or other shape to rotationally interlock whereby coupling element 72 will drive shaft 26.

A circumferential flange 79 near the outer end of coupling element 72 bears against the inside of the end of support member 61 and retains the element 72 longitudinally within its housing upon completion of the assembly.

The outer end of channular cap member 62 has a recess 80 complementary to the outer recess 73 of support member 61, and which cooperates therewith to secure coupling element in the housing.

For the purpose of actuating the limit switch terminals 69 and 70 flange 79 has a radial knob or pin 81 thereon.

When element 72 is rotated in one direction it approaches an extreme position for the slats 15 and pin 81 engages terminal 69 and opens the motor circuit thereby stopping the tilting movement. When element 72 is rotated in the opposite direction to the opposite extreme position for the slats 15 the pin 81 engages terminal 70 and opens the motor circuit thereby stopping the tilting movement.

For the purpose of providing selectivity in predetermining the extreme positions for slats 15 different coupling elements 72 are inventoried by the manufacturer who can select the coupling desired by the customer before assembling the power unit.

FIG. 14 illustrates an alternate coupling element 72 for this selection. The coupling element 72 of FIG. 14 is the same as that for FIGS. 10 to 12, except that the knob or pin 81 is made as a ridge 82 extending circumferentially of element 72 for a given distance to provide engagement with terminals 69 and 70 with less rotational movement of element 72. The ridge 82 can be considered as two separate circumferentially spaced pins each operative to engage one of the terminals 69 and 70.

The knob or pin 81 and also ridge 82 essentially provide two oppositely facing circumferentially spaced abutment surfaces, each disposed to engage and actuate a corresponding limit switch terminal 69 or 70.

In order to properly orient the pin 81 or ridge 82 with respect to shaft 26 for assembly purposes, a pin 83 is formed on the outer end of element 72 extending parallel to the axis of the element, and centered with respect to pin 81 or ridge 82 to aid the assembler when inserting shaft 26 into the element 72.

Referring to the modified circuit of FIG. 15 the limit switch terminals 69 and 70 are shown adapted to engage a common fixed terminal 71 leading to one side of the motor.

The limit switch terminals are disposed in separate branches 85 and 86 of line 87 leading from the control switch 33.

Oppositely directed diodes 88 and 89 are disposed in the corresponding branches 85 and 86 so that when the motor is being operated in a direction moving pin 81 toward terminal 69 the latter becomes operative to open the motor circuit, and when the motor is being operated in a direction moving pin 81 toward terminal 70 the latter becomes operative to open the motor circuit.

The line 90 leads from motor 25 back to control switch 33.

The control switch 33 of FIG. 15 is shown as a double pole double throw switch similar to that of FIG. 9, adapted to connect battery 32 to the motor selectively to provide for directional flow of current to the motor to determine its direction of rotation.

With the use of the circuit of FIG. 15 it is necessary to employ only two wires leading from the remote control box to the motor and limit switch assembly, whereas in FIG. 9 five wires appear to be necessary.

If desired, electrical jack terminals 91 may be provided in the lines between battery 32 and control switch 33 for plugging in an alternate power source such as from a rectifier in the secondary circuit of a transformer, not shown.

Also if desired, a receptacle 92 may be connected to lines 87 and 90 to provide for plugging in of additional blind actuating power units.

Various automtic controls for switch 33 may be employed and the switch can be located in a master control room for a group of windows, if desired.

The venetian blind may be of a type employing vertical slats, in which case the drive shaft may be connected to the slats by different means to effect the operation thereof.

Various modes of carrying out the invention are contemplated as being within the scope of the following claims particularly pointing out and distinctly claiming the subject matter which is regarded as the invention.

I claim:

1. In a venetian blind drive and control, a reversible rotary direct current electric motor, a source of direct current connected to drive said motor, switch means in the motor circuit operable to select the direction of motor rotation and to determine the increment of movement in either direction, a speed reduction gear train driven by said motor selectively in either direction in accordance with the direction of motor rotation, an output shaft for said gear train, a cross shaft for said blind in axial alignment with and coupled at all times to said output shaft and connected to the slats of the venetian blind to provide a predetermined tilt adjustment for the latter between predetermined opposite closure positions by a partial revolution of said cross shaft, a separate limit switch connected directly in a branch of the power circuit of said motor for each direction of operation of the motor, and separate abutment means generally carried by and rotatable with at least one of said shafts to actuate corresponding of said limit switches to open the motor circuit and stop said motor upon said shafts reaching a limit of rotation corresponding to a predetermined position of blind operation in either of the selected directions.

2. The device of claim 1 in which said direct current source comprises a battery, said switch means is manually operable, and a remote control box contains said battery and said switch means, said motor and said remaining elements being disposed in the head rail of the blind.

3. The device of claim 1 in which a diode is employed in each branch line for said limit switches to determine operativeness of each given switch in accordance with the direction of current flow to the motor.

4. The device of claim 1 in which a coupling element connects the output shaft for said gear train and the cross shaft for said blind, and radially projecting means on said coupling element actuates said limit switches in response to rotation of said coupling.

5. The device of claim 4 in which said projecting means comprise oppositely facing circumferentially spaced abutments adapted to engage the corresponding limit switches to open the motor circuit.

6. The device of claim 5 in which said coupling element is selectively interchangeable with like elements having the abutment surfaces thereof spaced differently to provide for ready predetermination of the range of tilt movement for the blind.

* * * * *